United States Patent [19]

Tanaka et al.

[11] Patent Number: 4,535,583

[45] Date of Patent: Aug. 20, 1985

[54] ROTARY TYPE CAPPING APPARATUS

[75] Inventors: Hideo Tanaka; Shiaru Muranaka, both of Kanazawa, Japan

[73] Assignee: Shibuya Kogyo Co., Ltd., Japan

[21] Appl. No.: 537,465

[22] Filed: Sep. 29, 1983

[30] Foreign Application Priority Data

Oct. 4, 1982 [JP] Japan ..... 57-174235
Oct. 4, 1982 [JP] Japan ..... 57-174236

[51] Int. Cl.[3] ..... B65B 57/00; B67B 3/26

[52] U.S. Cl. ..... 53/75; 53/317; 53/331.5; 192/84 PM

[58] Field of Search ..... 53/75, 76, 317, 331, 53/331.5; 192/84 E, 84 PM

[56] References Cited

U.S. PATENT DOCUMENTS 2,884,751 5/1959 Bjering ..... 53/317
2,886,149 5/1959 Baermann ..... 192/84 PM
3,491,516 1/1970 Bergeron ..... 53/317
4,485,609 12/1984 Kowal ..... 53/317

FOREIGN PATENT DOCUMENTS 2938168 4/1980 Fed. Rep. of Germany ..... 53/331

*Primary Examiner*—Robert L. Spruill
*Assistant Examiner*—Richard M. Mudd
*Attorney, Agent, or Firm*—Thomas S. MacDonald; Alan H. MacPherson; Steven F. Caserza

[57] ABSTRACT

A rotary type capping apparatus for screwing caps onto the mouths of containers includes a turn table provided with a plurality of container holders fixedly mounted along the periphery thereof, a main motor for rotating the turn table in a predetermined direction and a capping head assembly including a plurality of cap holders, each of which is disposed above the corresponding one of the plurality of container holders, so as to be movable closer to or away from the turn table. In one aspect of the present invention, the capping apparatus includes at least one motor exclusively used for rotating the cap holders for causing the caps held by the cap holders to be screwed onto the mouths of containers. In another aspect of the present invention, the capping apparatus is so structured to increase the torque applied to a cap until it has reached a predetermined level during the cap screwing operation thereby insuring that all caps may be screwed on as tightly as desired.

13 Claims, 7 Drawing Figures

ROTARY TYPE CAPPING APPARATUS

BACKGROUND OF THE INVENTION

1. Field of the Invention

This invention relates to apparatuses for capping containers such as bottles, and in particular to rotary type capping apparatuses for screwing caps, such as screw caps and PP ( pilferproof ) caps, onto the mouth of containers for tight sealing thereof.

2. Description of the Prior Art

Various capping apparatuses have been used for automatically capping bottles after having them filled with desired contents. One category of such capping apparatuses includes rotary type capping apparatuses in which caps are screwed onto the mouth, which is usually threaded, of containers to be capped. Typical examples of caps to be used in this category of capping apparatuses include screw caps and the so-called PP (pilferproof) caps which may be removably and tightly held onto the mouth of containers when screwed. Thus, in typical prior art rotary type capping apparatuses, containers transported from a previous station as filled with desired contents are temporarily held in position, and then capping heads having caps to be applied to the containers are lowered thereby having the caps screwed onto the mouths of the containers.

Typically, the prior art rotary type capping apparatuses include a rotary turn table having a plurality of container holders disposed along the periphery of the table and a plurality of capping heads which are each provided corresponding in position to the container holders and driven to move along a circular path together with the turn table. Each of the capping heads has a cap holder which releasably holds a cap at its bottom and which is driven to rotate so as to have the cap screwed onto the mouth of the container held by the corresponding container holder on the turn table. In such prior art rotary type capping apparatuses, a fixed sun gear is commonly provided coaxially with a rotary shaft of the turn table and a plurality of pinions are provided in mesh with and disposed around the sun gear. Each of the pinions is fixedly provided on a driving shaft which is operatively connected to the corresponding cap holder so that the cap holder may be driven to rotate when the corresponding pinion moves around the sun gear in mesh therewith, thereby causing the cap held by the cap holder to be screwed onto the mouth of the corresponding container.

However, in such prior art rotary type capping apparatuses, since the rotation of each pinion around its own axis depends upon the rotation of the turn table, a torque for screwing a cap onto a container is directly determined by the rotation of the turn table. As a result, if the rotation of the turn table varies, the screwing torque also varies accordingly. This has been found to be extremely disadvantageous because the rotational speed of the turn table is sometimes desired to be set at different levels in connection with other processing stations in the same container handling line, such as a filling station where desired contents are filled in containers and a labelling station where labels are glued to containers. Moreover, when the turn table is accidentally halted for some reason, an operator cannon be sure as to which of the containers then held on the turn table are properly capped, and, thus, all of the containers must be inspected one by one before resuming the capping operation. Still further, since the screwing torque is a function of the rotational speed of the turn table, as set forth above, the degree of cap tightening tends to fluctuate thereby requiring a careful inspection after capping, or, alternatively, provision of an expensive speed control mechanism for maintaining the rotational speed at a desired value at all times.

SUMMARY OF THE INVENTION

The disadvantages of the prior art as described above have been obviated and an improved rotary type capping apparatus is hereby provided.

Therefore, it is a primary object of the present invention to provide an improved rotary type capping apparatus.

Another object of the present invention is to provide a rotary type capping apparatus whose operational speed may be varyingly set at a desired level without causing any problem.

A further object of the present invention is to provide a rotary type capping apparatus capable of having caps screwed onto the mouth of containers tightly with a predetermined screwing torque at all times.

A still further object of the present invention is to provide a rotary type capping apparatus which is particularly suited for use in attaching such caps as screw caps and PP caps as screwed onto the mouth of containers filled with desired contents.

A still further object of the present invention is to provide a rotary type capping apparatus which may be easily incorporated into a container processing line which typically includes such stations as filling and labelling stations.

Other objects, advantages and novel features of the present invention will become apparent from the following detailed description of the invention when considered in conjunction with the accompanying drawings.

DESCRIPTION OF THE PREFERRED EMBODIMENTS

Figure 1:
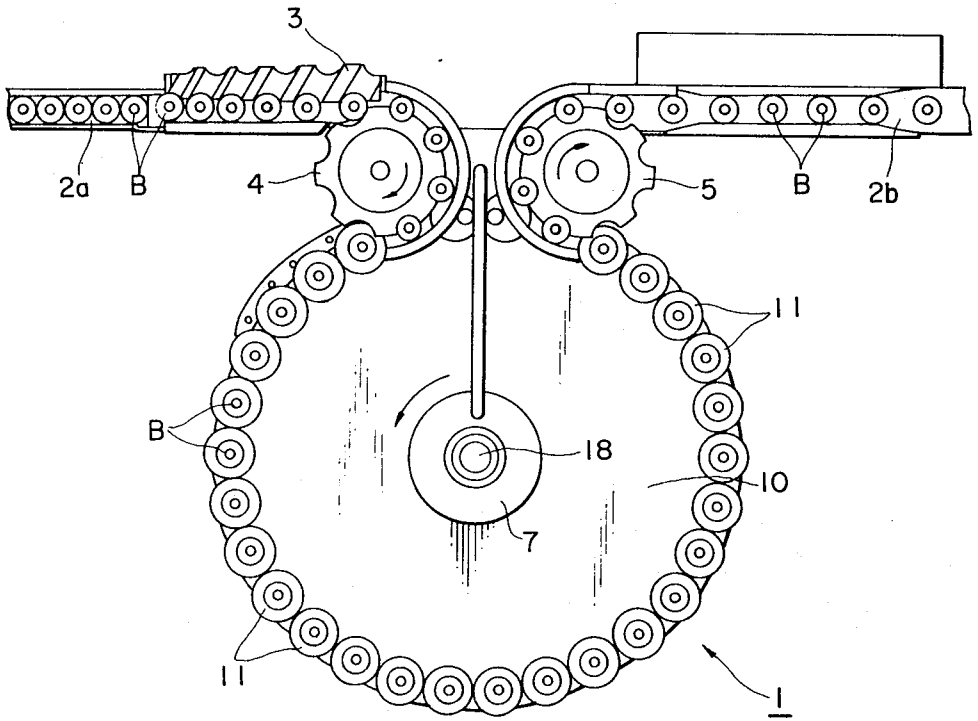
FIG. 1 is a plan view schematically showing the rotary type capping apparatus constructed in accordance with one embodiment of the present invention with its capping head assembly removed to show how containers B move through the apparatus.

Referring now to FIG. 1, there is schematically shown in plan view the rotary type capping apparatus constructed in accordance with the present invention with its capping head assembly removed so as to show how containers B (bottles in the illustrated example) pass through the apparatus. As shown in FIG. 1, containers B are transported from a previous station such as a filling station (not shown), where desired contents are filled in each of the containers which are riding on a conveyor belt 2a upright. The containers B on the conveyor belt 2a are shown to be arranged in a line in contact between adjacent ones, but their spacings may vary. At the end of the conveyor belt 2a is disposed a timing screw 3 which is driven to rotate along its longitudinal axis thereby receiving the containers B from the conveyor belt 2a and setting the spacing between the containers B at a predetermined value as they are moved from one end to the other in engagement with timing screw 3. Also disposed adjacent to the timing screw 3 is an inlet star wheel 4 which is driven to rotate in the direction indicated by the arrow so that the inlet star wheel 4 receives the properly spaced containers B from the timing screw 3 and causes them to be introduced into the capping apparatus 1.

As will be described more fully later, a plurality of container holders 11 for securely holding the containers B in position temporarily are mounted along the periphery of a turn table 10. Such container holders 11 are well known in the art and thus a detailed description will not be made as to their structure. The turn table 10 is also driven to rotate in the direction indicated by the arrow, counterclockwise direction in the illustrated example, and, thus, the containers B supplied to the turn table 10 from the inlet star wheel 4 are sequentially placed into the container holders 11. Accordingly, the containers B move along a circular path securely supported by the container holders 11 as the turn table 10 is driven to rotate and at the end of such a circular path the containers B come into engagement with an outlet star wheel 5 which is also driven to rotate in the direction indicated by the arrow. Although not shown specifically, it should be understood that a capping head assembly is provided coaxially and above the turn table 10 so that caps are tightly screwed onto the mouths of the containers B while they are transported along the circular path by the turn table 10 securely held by the container holders 11. The containers B thus capped are removed from the turn table 10 by the outlet star wheel 5 and transferred to another conveyor belt 2b which then transports the capped containers B to the next station for further processing.

Figure 2:
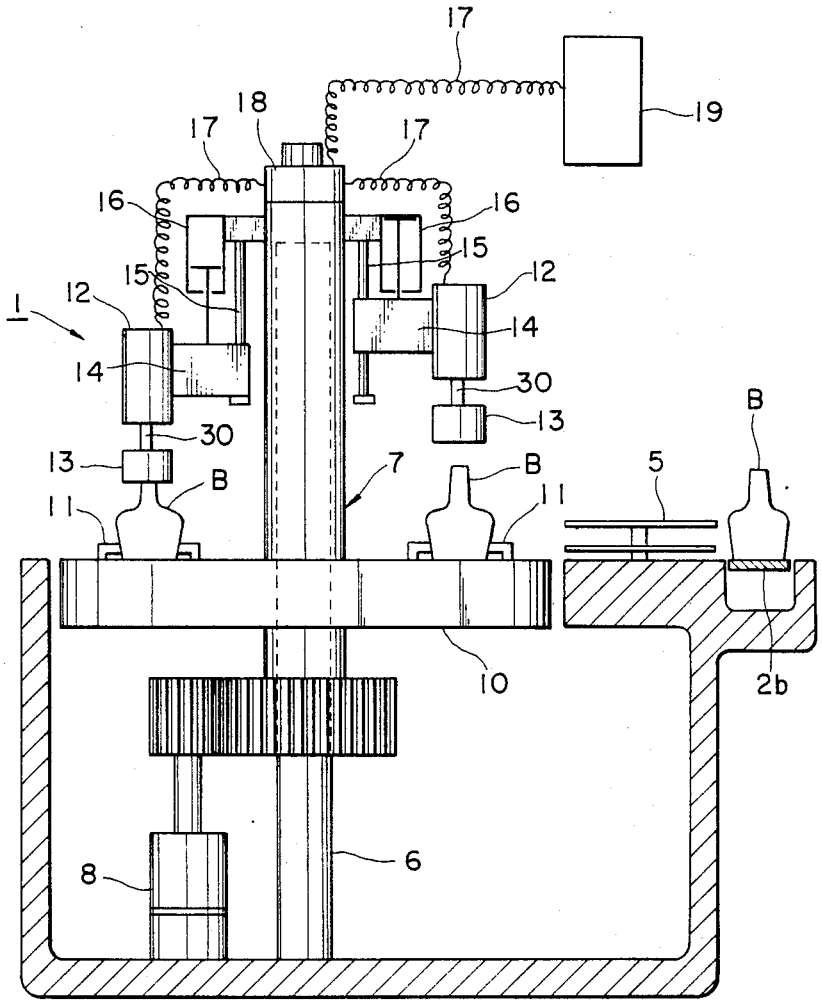
FIG. 2 is a schematic cross-sectional view showing the overall structure of the rotary type capping apparatus shown in FIG. 1.

As shown in FIG. 2, the capping apparatus 1 includes a vertical column 6, which is fixed in position, and a rotary cylinder 7 which is rotatably fitted onto the stationary, vertical column 6. The turn table 10 is fixedly mounted on the rotary cylinder 7 which is in driving connection through a gear train with a main motor 8 fixedly mounted at the bottom of the apparatus. Accordingly, the rotary cylinder 7 and thus the turn table 10 are driven to rotate by means of the main motor 8. Although not shown specifically, the main motor 8 is operatively associated with operational speeds of other stations such as filling and labelling stations in the same container processing line, and, thus, it is structured such that the rotational speed of the turn table and thus capping speed may be set varyingly in synchronism with the associated stations.

As described above, the turn table 10 is provided with a plurality of container holders 11 as arranged along the periphery thereof at an equally spaced interval. Also provided above and integral with the rotary cylinder 7 is a capping head assembly which includes a plurality of cap holders 13 arranged above in registry in position with and movable closer to or away from the corresponding container holders 11. As shown in FIG. 2, each of the cap holders 13 is fixedly attached at the bottom end of a driving shaft 30, which, in turn, is connected to a corresponding driving motor 12. The detailed structure regarding the cap holder 13 and the connection between the cap holder 13 and the driving motor 12 will be given later. The driving motor 12 is fixedly mounted on a bracket 14 which is fixedly supported by a piston rod of a cylinder actuator 16, which, in turn, is fixedly mounted to the rotary cylinder 7. The bracket 14 is provided with a through-hole (not shown) through which a guide rod 15 provided integrally with the rotary cylinder 7 passes. Thus, each capping head comprised of the driving motor 12, cap holder 13 and bracket 14 may be moved vertically as controlled by the cylinder actuator 16 and guided by the guide rod 15 so as to move the cap holder 13 closer to or separated away from the mouth of the corresponding container B securely held in position by the container holder 11. Such capping heads are typically provided equal in number to the container holders 11 as arranged around the rotary cylinder 7 to form a capping head assembly. One of the cap holders 13 shown in FIG. 2 takes a raised position where the cap holder 13 is located separated away from the mouth of the container B held by the corresponding container holder 11 and the other cap holder 13, i.e., the one shown to the left of the rotary cylinder 7 in FIG. 2, takes a lowered position where the cap holder 13 is located to be in engagement with the mouth of the container B held by the corresponding container holder 11 so as to carry out capping operation.

Also provided on top of the rotary cylinder 7 is a rotary joint 18 from which an electrical line 17 extends to a control circuit 19 which controls the overall operation of the present capping apparatus 1. A plurality of electrical lines 17 also extend from the rotary joint 18 and each of these electrical lines 17 is connected to the corresponding driving motor 12. Thus, the operation of each of these driving motors 12 may be individually controlled by the control circuit 19. Of importance, in accordance with the present invention, it is so structured that the driving motors 12 for use in driving to rotate their cap holders 13 thereby having caps screwed onto the mouths of containers are separately provided and thus driving control of the cap holders 13 may be carried out independently of the rotating condition of the turn table 10 which is driven by the main motor 8.

In operation, when the main motor 8 is turned on, it drives to rotate the rotary cylinder 7 and the turn table 10 around the vertical column 6. At the same time, the inlet and outlet star wheels 4 and 5 are synchronously driven to rotate so that the containers B filled with desired contents and transported by the conveyor belt 2a are sequentially placed onto the container holders 11 to be securely held thereto temporarily. On the other hand, caps to be applied as screwed onto the mouths of containers B are supplied individually to the cap holders 13, for example, at a location above the inlet star wheel 4 by means of a cap supplying mechanism (not shown). As the turn table 10 rotates with the containers B held in position by the container holders 11 and caps releasably held by the cap holders 13, the cap holders 13 are lowered sequentially by means of the cylinder actuators 16 so that the caps held by the cap holders 13 become screwed onto the mouths of containers B since the cap holders 13 are also driven to rotate by means of the individual driving motors 12 through the driving shafts 30. In each of the cap holders 13, when the cap screwing torque has exceeded a predetermined level, a clutch (not shown) is activated to decouple the cap holder 13 from its driving motor 12. Such a clutch may be structured to utilize spring force or air pressure. Instead of using a clutch, it may be so structured to stop the driving motor 12 when the torque is detected to have exceeded a predetermined level.

Thereafter, the cap holder 13 releases the cap which is now tightly screwed onto the mouth of container B and then it is moved upward to be separated away from the container B by means of the corresponding cylinder actuator 16. At the same time, the clutch is operated to reestablish driving connection between the driving motor 12 and the cap holder 13 so that the cap holder 13 resumes its rotation. Then as the containers B thus capped approach the outlet star wheel 5 due to rotation of the turn table 10, the container holders 11 release the containers B to be transferred to the outlet star wheel 5 so that the containers B become discharged out of the capping apparatus 1 and transported to the next station on the conveyor belt 2*b*.

Even if the rotational speed of the turn table 10 is changed between high and low levels by means of the main motor 8 for some reason, since the cap holders 13 are driven to rotate by separate driving motors 12 independently of the rotational speed of the turn table 10, containers B may be sealed with caps with proper tightness at all times. Even if the turn table 10 comes to a temporary halt due to various reasons, all of the containers B then held on the turn table 10 by means of the container holders 11 may be properly capped because the cap holders 13 may be driven individually by the individual driving motors 12. Thus, at the time of resuming capping operation, it is insured that all of the containers B present on the turn table 10 are properly capped and thus no extensive check-up is necessary.

It is to be noted that although driving motors 12 are provided one for each of the cap holders 13 in the above-described embodiment, it may also be so structured to provide a single such driving motor 12 and a driving train such as gear, belt and chain train to operatively couple the driving motor 12 to each of the cap holders 13. Thus, the driving motors 12 may be provided as many as desired without departing from the spirit and scope of the present invention as long as an independent driving source separate from a driving source for driving to rotate the turn table is provided. Furthermore, the container holders 11 may be structured such that they may raise and lower the containers B with respect to the turn table 10 instead of or in addition to the provision of the cylinder actuators 16. As mentioned at the outset, it is to be noted that various caps of the type which may be attached to the mouth of a container by screwing motion such as screw caps and PP caps may be employed in the present capping apparatus.

Figure 3:
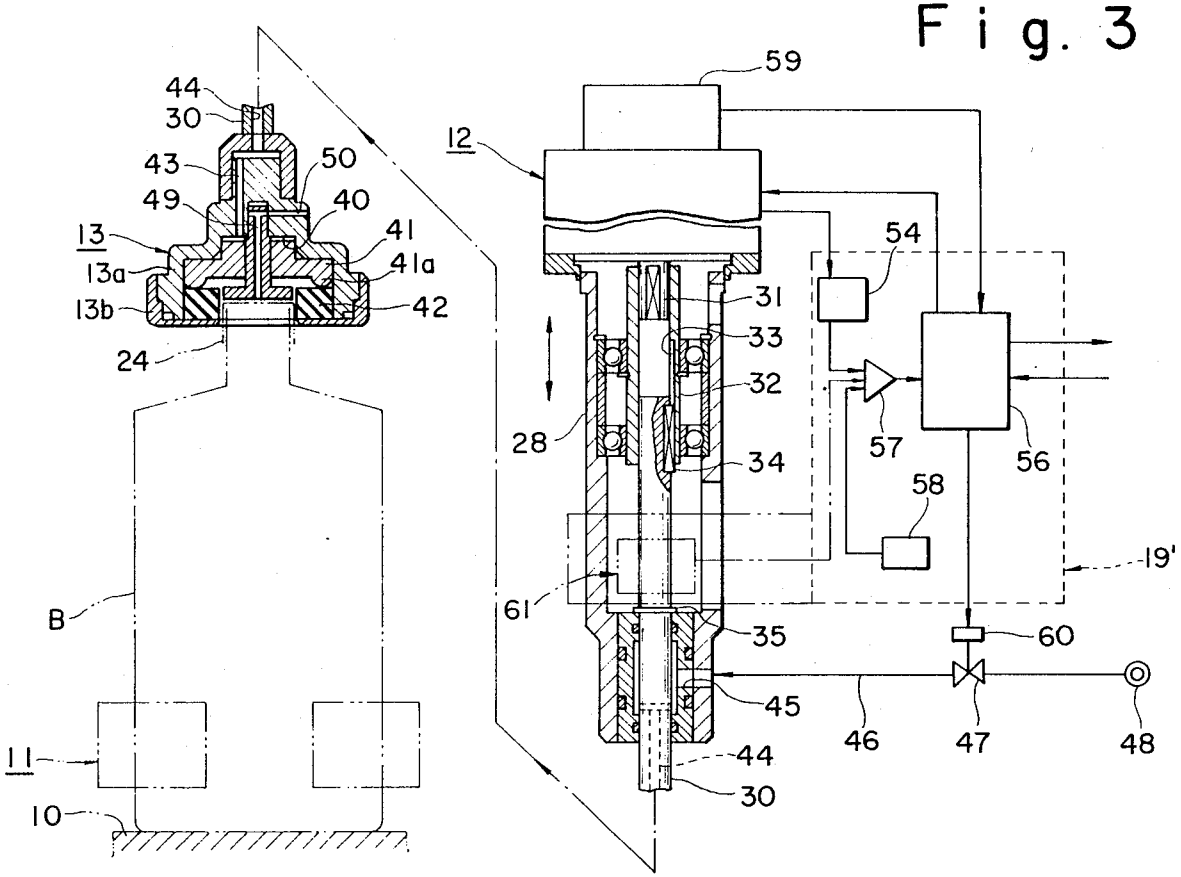
FIG. 3 is a schematic illustration showing the detailed structure of one of the capping heads of the capping apparatus shown in FIGS. 1 and 2.

Referring now to FIG. 3, there is shown in greater detail the cap holder 13 and its driving mechanism which may be advantageously applied to the capping apparatus illustrated in FIGS. 1 and 2. As shown, the container B sits upright on the turn table 10 securely held in position by the container holder 11. The container B has a mouth at its top and a cap 24 is shown as just having been screwed onto the mouth by the cap holder 13 which is located above the container B at its lowered position as described before. As also set forth previously, the cap holder 13 is operatively connected to the driving motor 12, which is typically comprised of a torque motor, through the driving shaft 30. It is to be noted that the driving shaft 30 is not directly connected to the motor 12, but the top end portion of the driving shaft 30 extends into a cylinder housing 28 which is fixedly attached to the bottom of a housing of the motor 12. The top end portion of the driving shaft 30 is rotatably supported by the cylinder housing 28 and its top end is loosely fitted into an interconnection tube 32 provided with a slot 33 extending in the longitudinal direction of the tube 32. A key 34 is fixedly mounted at the top end of the driving shaft 30 as shown and slidably received in the slot 33. The top end of the interconnection tube 32, on the other hand, is integrally and tightly fitted into a rotary shaft of the motor 12. As a result, when the motor 12 is turned on to rotate its rotary shaft 31, the rotating power is transmitted to the driving shaft 30 through the tube 32 and the engagement between the slot 33 and the key 34. Thus, the driving shaft 30 rotates integrally with the motor 12 but it can move with respect to the motor 12 along its longitudinal axis. A stopper 35 is formed on the driving shaft 30 so as to prevent the driving shaft 30 from slipping away. Such a relief structure is quite advantageous because undesired forces such as shocks may be prevented from being applied to the container B when the capping head including the motor 12 and the cap holder 13 is descended by means of the cylinder actuator 16 so as to bring the cap 24 in contact with the mouth of container B for attachment.

As to the structure of the cap holder 13, there is provided a pressure chamber 40 which is in fluidic connection with an electromagnetic valve 47 through pressure gas passages 43, 44 and 45 and a conduit 46. The valve 47 provides a fluidic connection from the pressure chamber 40 to a compressed air source 48 through the conduit 46 when opened. The pressure chamber 40 has its bottom surface defined by a top surface of a pressure disc 41 which is slidably fitted into a recess formed in the outer housing 13*a* of the cap holder 13. A ridge 41*a* is formed at the bottom periphery of the pressure disc 41 and the disc 41 sits on an elastic ring 42 with its ridge 41*a* in contact therewith. The elastic ring 42 and thus the pressure disc 41 is held in position by a cover 13*b* provided with a hole through which the cap 24 may be inserted. In addition, ventilation passages 49 and 50 are provided so as to have the space defined between the cap holder 13 and the cap 24 so held fluiddynamically connected to the atmosphere. Thus, when pressurized air is supplied to the pressure chamber 40 from the pressure air source 48, the pressure disc 41 is forced to move downward thereby pushing the elastic ring 42 with its peripheral ridge 41*a* against the supporting cover 13*b*. Accordingly, the elastic ring 42 such as a rubber ring deforms to diminish its internal diameter thereby holding the cap 24.

Also shown in FIG. 3 is the control circuit 19' for controlling the operation of the torque motor 12 and the electromagnetic valve 47. The control circuit 19' includes a controller 56 such as a microprocessor, a detector 54 for detecting the driving condition of the motor 12, a comparator 57 and a torque level setting unit 58, and it is connected to the motor 12, to a rotary encoder 59 mounted on top of the motor 12, to a solenoid 60 which causes to close or open the valve 47 and to other appropriate components. The control circuit 19' receives a signal indicating the rotational speed of the torque motor 12 from the rotary encoder 59 to control the rotational speed of the motor 12 at a desired level.

The torque level setting unit 58 is to set a desired maximum level for the cap screwing torque. The comparator 57 receives and compares a set torque signal from the unit 58 with a signal indicating the current torque of the motor 12 as detected by the detector and supplies an output signal to the controller 56 indicating when the detected signal has exceeded the predetermined maximum torque level.

With the above-described structure, when the capping head of FIG. 3 takes the raised position, the motor 12 is set in rotation at a predetermined rotational speed with a low rotating torque under the control of the controller 56. Then the container B is introduced and securely held by the container holder 11; while the cap 24 is supplied from the cap supplying mechanism (not shown) to be inserted into the rubber ring 42. A signal indicating the insertion of the cap 24 into the ring 42 as detected by a sensor (not shown) is fed into the controller 56 which then causes the solenoid 60 to be energized thereby causing the electromagnetic valve 47 to be open. As a result, compressed air is supplied into the pressure chamber 40 from the pressurized air source 48 whereby the rubber ring 42 becomes deformed by the pressure disc 41 thereby firmly gripping the cap 24 as inserted in the rubber ring 42.

Then the capping head of FIG. 3 descends as controlled by the cylinder actuator 16 and guided by the guide rod 15 as shown in FIG. 2, so that the mouth of container B securely held by the corresponding container holder 11 becomes fitted into the cap 24 held by the cap holder 13. In this instance, since the cap holder 13 and thus the cap 24 held by the cap holder 13 are in rotation as driven by the motor 12, the cap 24 is automatically screwed onto the mouth of container B. As the cap 24 becomes tightly screwed onto the mouth of container B, the cap holder 13 decreases its rotational speed and eventually stops its rotation. Such a condition is detected by the rotary encoder 59, and thus the controller 56 supplies a signal to the torque motor 12 to increase its rotating torque thereby causing the screwing torque of the cap holder 13 to increase. Under the condition, when the comparator 57 detects that the screwing torque had exceeded a predetermined maximum level set by the torque setting unit 58, the controller 56 supplies a signal to stop increasing the screwing torque and at the same time to have the solenoid 60 deenergized to shut the valve 47 thereby allowing the pressurized air in the pressure chamber 40 to be released, so that the cap holder 13 releases the cap 24 which is now tightly screwed onto the mouth of container B.

Thereafter, the capping head of FIG. 3 again returns to the raised position and the controller 56 decreases the rotating torque of the motor 12 as the rotational speed of the torque motor 12 increases. On the other hand, the container B thus tightly sealed with the cap 24 is released from the container holder 11 and transferred to the conveyor belt **2*b* by means of the outlet star wheel 5** to be transported to the next processing station.

It is preferable to arrange that the controller 56 supplies a signal to an alarm device (not shown) in the case where the comparator 57 fails to supply a signal to the controller 56 even if the level of torque increased by the controller 56 has exceeded a maximum level set by the unit 58. Instead of or in addition to activating an alarm device, the inlet and outlet star wheels 4 and 5 are preferably stopped thereby preventing the containers B having improperly screwed caps from being transported to the next station.

In the above-described embodiment, use is made of the detector 54 for detecting the rotational condition of the motor 12 by measuring current or voltage at the motor 12. As an alternative approach, a torque detector 61 may be provided to the driving shaft 30 so as to detect the level of torque being applied to the driving shaft 30 directly as indicated by the phantom line. In this instance, a desired torque level may be set in the unit 58, and the comparator 57 is so connected to receive a torque signal from the torque detector 61 and compare it with a set torque signal from the unit 58. Various known torque detectors may be used by those skilled in the art. One example of such torque detectors is the one in which a twisting angle of the driving shaft 30 proportional to the screwing torque is used for detection as transformed into phase differences between a pair of alternating voltage signals.

Figure 5:
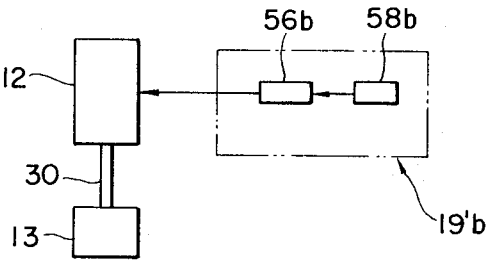
FIGS. 4 through 6 are block diagrams showing several modifications of the screwing torque control circuit for use in the present rotary type capping apparatus.
Figure 4:
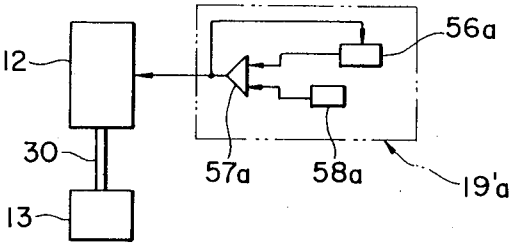
Figure 6:
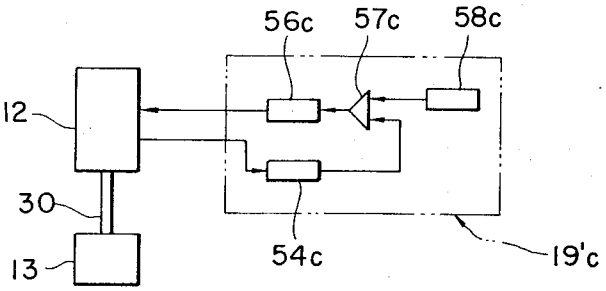

FIGS. 4 through 6 are several modifications of the control circuit 19' which may be used in the present capping apparatus. In the structure shown in FIG. 4, the control circuit **19'*a* includes a controller 56*a* which detects the condition that the cap holder 13 has been set in the lowered position, for example, by means of a limit switch (not shown) thereby causing the output torque of the motor 12 to be changed from the lowest level to the highest level. The control circuit 19'*a* of FIG. 4 also includes a comparator 57*a* which compares the torque level supplied from the controller 56*a* with a torque level set at a maximum torque setting unit 58*a*. When the comparator 57*a* detects the condition that the torque level supplied from the controller 56*a* has exceeded the level set at the unit 58*a*, it supplies a signal indicating to this effect to the controller 56*a* which then supplies a control signal which causes the output torque of motor 12** to reduced to the lowest level.

FIG. 5 shows another control circuit **19'*b* which includes a controller 56*b* which maintains the output torque of motor 12 at a predetermined level as set at a torque level setting unit 58*b*. FIG. 6 shows a further control circuit 19'*c* which is modified from the structure shown in FIG. 5 by adding a feed back circuit. That is, the control circuit of FIG. 6 includes a torque detector 54*c* which detects a maximum output torque attained during screwing operation. The detected torque signal is supplied to a comparator 57*c* which compares it with a torque level set at a torque level setting unit 58*c* and supplies a difference signal indicating the difference between the two inputs to a controller 56*c*, which, in turn, supplies a control signal in response to the difference signal to the motor 12** so as to adjust its output torque accordingly.

Figure 7:
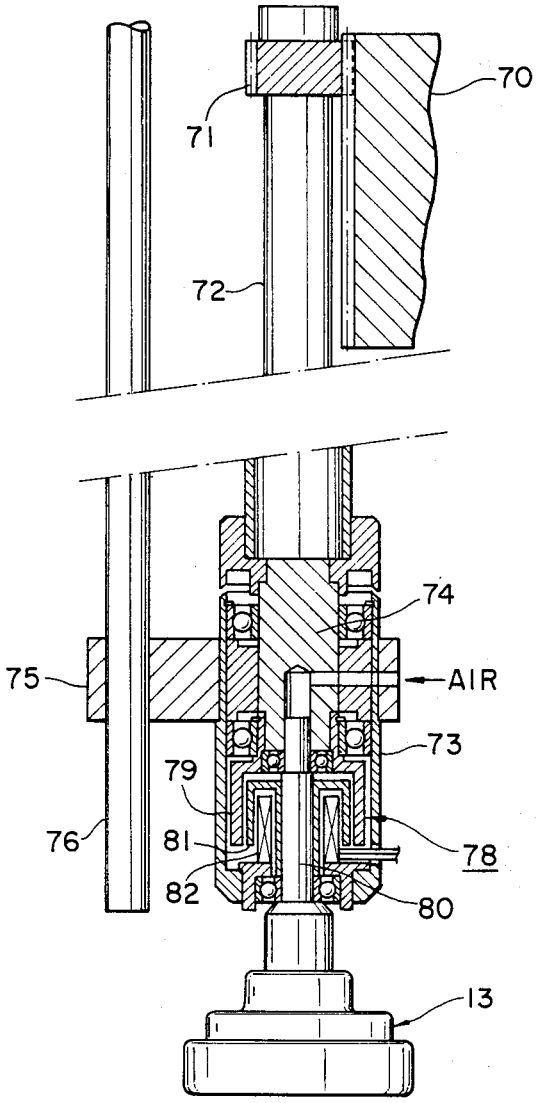
FIG. 7 is a fragmentary, cross-sectional view showing another embodiment of the capping head which may be advantageously used in the present capping apparatus.

Now, reference will be made to FIG. 7 which shows another embodiment of the present invention. The structure of FIG. 7 includes a stationary sun gear 70 and at least one pinion 71 which moves around the periphery of the sun gear 70 in mesh therewith and rotating around its own axis. The pinion 71 is fixedly mounted on a driving shaft 72 whose bottom end is fixedly interconnected to a rotary member 74 which is rotatably housed in a housing 73. This housing 73 is fixedly mounted on a bracket 75 which is provided with a vertical through-hole through which extends a guide rod 76 which is provided integrally with the turn table which is disposed generally below the cap holder 13 and coaxially with the sun gear 70. Thus, the cap holder 13 may be moved up and down, for example, by a cam mechanism (not shown) as guided by the guide rod 76 as the turn table rotates. In this case, the bracket 75 slides along the guide rod 76 and the pinion 71 also moves up and down along the peripheral surface of the sun gear 70 as meshed therewith.

The cap holder 13 is provided below the rotary member 74 and an electromagnetic torque transmitting mechanism 78 is provided as interposed therebetween. The torque transmitter 78 includes an outer cylindrical member 79 which is integrally mounted at the bottom of the rotary member 74, an inner cylindrical member 81 which is positioned inside of the outer cylindrical member 79 and integrally mounted on a supporting shaft 80 of the cap holder 13 and an energization coil 82 disposed inside of the inner cylindrical member 81 and fixedly mounted on the housing 73. In accordance with the level of energization current passed through the coil 82, the coupling condition and thus amount of torque transferred between the outer and inner cylindrical members 79 and 81 may be suitably controlled. In this embodiment, just by controlling the level of current passed through the coil 82, the level of screwing torque may be appropriately controlled. Any of the control circuits shown in FIGS. 4 through 6 may be directly applied to the present embodiment without substantial changes in structure. It is to be noted that provision of a separate driving source, such as a motor, for driving to rotate the cap holder 13 is not necessary in this embodiment. Even if the rotational speed of the turn table varies, tightening condition of caps may be insured by suitably varying the screwing torque by changing the level of energization current to be supplied to the coil 82.

While the above provides a full and complete disclosure of the present embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. Apparatus for capping screw caps onto the mouths of containers, comprising:

carrier means for securely and temporarily carrying said containers;

cap holding means for releasably holding said caps to cap said containers, said cap holding means being rotatably supported;

driving means for rotating said cap holding means in a predetermined direction, said driving means including a torque motor which is operatively connected to said cap holding means so as to rotate said cap holding means in said predetermined direction;

moving means for moving said cap holding means between an operative position where capping is to be carried out and an inoperative position where said cap holding means is located away from said containers carried on said carrier means; and control means for controlling said driving means to increase the torque of said cap holding means until a predetermined level is reached while said cap holding means are capping said caps onto the mouths of said containers, said control means including first detecting means for detecting the rotating condition of said torque motor and a control circuit for controlling the torque of said cap holding means in accordance with information supplied from said first detecting means.

2. Apparatus of claim 1 wherein said carrier means includes a turn table which is supported to be rotatable around its center axis, drive means for driving said turn table in a predetermined direction, and a plurality of container holders fixedly mounted on said turn table along the periphery thereof at equal intervals for securely and temporarily holding said containers on said turn table, whereby said containers are moved along a predetermined circular path.

3. Apparatus of claim 2 further including a separate motor which is operatively connected to said turn table such that said turn table may be rotated by said separate motor.

4. Apparatus of claim 1 further comprising means for automatically introducing said containers which have not yet been capped one by one into said carrier means at a predetermined inlet position.

5. Apparatus of claim 4 wherein said means for introducing includes a star wheel which is driven to rotate thereby introducing said containers from said carrier means one by one at regular intervals.

6. Apparatus of claim 4 further comprising means for automatically discharging said containers from said carrier means at a predetermined outlet position.

7. Apparatus of claim 6 wherein said means for discharging includes a star wheel which is driven to rotte thereby discharging said containers carried on said carrier means one by one at a regular interval.

8. Apparatus of claim 1 wherein said cap holding means includes a deformable ring having an inner diameter allowing one of said caps to be inserted therein and an actuating means for causing said ring to decrease its inner diameter when actuated thereby firmly holding said cap releasably.

9. Apparatus of claim 8 wherein said actuating means includes a pressure disc which sits on said ring, a pressure chamber one surface of which is defined by the side of said disc opposite to the side in contact with said ring and means for supplying pressurized gas to said pressure chamber.

10. Apparatus of claim 9 wherein said disc is provided with a ridge at its bottom periphery and said disc sits on said ring with its ridge in contact therewith.

11. Apparatus of claim 1 wherein said driving means includes a driving shaft which is integrally connected to said cap holding means and said control means includes second detecting means for detecting the torque of said driving shaft and a control circuit for controlling the torque of said cap holding means in accordance with information supplied from said second detecting means.

12. Apparatus of claim 1 wherein said control means includes an electromagnetically operated torque transmitting mechanism as interposed between said driving means and said cap holding means.

13. Apparatus of claim 12 wherein said driving means includes a first cylinder and said cap holding means includes a second cylinder, said first and second cylinders being located to be operatively associated to each other, and wherein said control mean includes an energization coil capable of causing said first and second cylinders operatively associated when energized by passing current therethrough thereby transmitting torque from said first cylinder to said second cylinder, the rate of transmission of torque depending upon the level of current passed through said coil.

* * * * *